US009756888B2

(12) United States Patent
Ku

(10) Patent No.: US 9,756,888 B2
(45) Date of Patent: Sep. 12, 2017

(54) POWER-VENTILATED SOFT HEADGEAR

(71) Applicant: Tsu Kung Ku, Duluth, GA (US)

(72) Inventor: Tsu Kung Ku, Duluth, GA (US)

(73) Assignee: Tsu-Kung Ku, Duluth, GA (US)

( * ) Notice: Subject to any disclaimer, the term of this patent is extended or adjusted under 35 U.S.C. 154(b) by 115 days.

(21) Appl. No.: 14/792,349

(22) Filed: Jul. 6, 2015

(65) Prior Publication Data

US 2016/0007672 A1 Jan. 14, 2016

Related U.S. Application Data

(60) Provisional application No. 62/023,972, filed on Jul. 14, 2014.

(51) Int. Cl.
*A42B 1/24* (2006.01)
*A42B 1/00* (2006.01)

(52) U.S. Cl.
CPC ..... *A42B 1/24* (2013.01); *A42B 1/008* (2013.01)

(58) Field of Classification Search
CPC ..... A42B 1/24; A42B 1/008
See application file for complete search history.

(56) References Cited

U.S. PATENT DOCUMENTS 4,672,968 A * 6/1987 Lenox ..... A41D 13/1209 2/171.3
5,085,231 A * 2/1992 Johnson ..... A24F 47/00 131/329
6,081,929 A * 7/2000 Rothrock ..... A42B 3/286 2/171.3
6,122,773 A * 9/2000 Katz ..... A42B 3/286 2/171.3
6,760,925 B1 * 7/2004 Maxwell ..... A42B 3/285 2/171.3
2005/0132468 A1 * 6/2005 Lundgren ..... A42C 5/04 2/171.3
2010/0017941 A1 * 1/2010 Taylor ..... A42B 1/008 2/171.3
2012/0167282 A1 * 7/2012 Fleming ..... A42B 3/286 2/410
2014/0150163 A1 * 6/2014 Hatton ..... A42B 1/008 2/171.3
2015/0143613 A1 * 5/2015 Chu ..... A42B 1/008 2/171.3

* cited by examiner

*Primary Examiner* — Shaun R Hurley
*Assistant Examiner* — Andrew W Sutton

(57) ABSTRACT

A soft headgear is provided. The soft headgear includes a soft outer layer, an inner liner layer formed from an air permeable material, a rigid substructure disposed between the soft outer layer and the inner liner layer, an active ventilation system located at the crown of the soft headgear, and a power supply operably coupled to the active ventilation system. The rigid substructure includes a plurality of ribs extending radial from a crown of the soft headgear to a ring of the rigid substructure, thereby forming air conduction pathways. The active ventilation system exhausts air drawn in through the ring of the rigid substructure and out through the crown of the soft headgear. The power supply provides power for the active ventilation system.

2 Claims, 5 Drawing Sheets

CROSS SECTION

CROSS SECTION

POWER-VENTILATED SOFT HEADGEAR

This application claims the benefit of U.S. Provisional Application No. 62/023,972, filed on Jul. 14, 2014, entitled "Headgear Ventilation Device," which application is hereby incorporated herein by reference.

TECHNICAL FIELD

The present disclosure relates generally to head coverings, and more particularly to power-ventilated soft headgear.

BACKGROUND

A headgear protects the head of wearers by providing shade from the hot sun. The rays of the sun can cause severe sun damage to the delicate skin of the head, especially in persons with thin hair or who are bald, even when the temperature is mild. The headgear generally encapsulates the top portion of the head of the wearer and protects the head, while a brim provides protection from glare.

Unfortunately, the encapsulation of the top portion of the head also prevents air circulation and the stagnant air rapidly heats up, making the headgear uncomfortable to wear. Prior art discloses headgear with and without fans that provide ventilation of the stagnant air to allow for extended wear. However, the prior art discloses only hardhat headgear, which by their rigid nature, provide natural conduction pathways for air between the hardhat and the head of the user to move. Furthermore, hardhats are not conducive to being worn during athletic activities, such as golf, fishing, attending sporting events, and the like. Therefore, there is a need for soft headgear with power-ventilation to help keep the wearer comfortable for extended periods of time.

SUMMARY OF THE DISCLOSURE

Example embodiments provide for power-ventilated soft headgear.

In accordance with an example embodiment, a soft headgear is provided. The soft headgear includes a soft outer layer, an inner liner layer formed from an air permeable material, a rigid substructure disposed between the soft outer layer and the inner liner layer, an active ventilation system located at the top of the crown of the soft headgear, and a power supply operably coupled to the active ventilation system. The rigid substructure includes a plurality of ribs extending radial from a top of a crown of the soft headgear to a ring of the rigid substructure, thereby forming air conduction pathways. The active ventilation system exhausts air drawn in through the ring of the rigid substructure and out through the top of the crown of the soft headgear. The power supply provides power for the active ventilation system.

In accordance with another example embodiment, a soft headgear is provided. The soft headgear includes a soft outer layer, an inner liner layer formed from an air permeable material, a semi-spherical rigid substructure disposed in between the soft outer layer and the inner liner layer, an active ventilation system disposed in the hub, a power supply operably coupled to the active ventilation system. The semi-spherical rigid substructure includes a hub located at a top of a crown of the soft headgear, a ring located at a base of the soft headgear, and a plurality of ribs extending radially from the hub to the ring thereby forming air conduction pathways. The active ventilation system exhausts air drawn in through inlet vents formed in the ring of the semi-spherical rigid substructure through the air conduction pathways and out through the crown of the soft headgear. The power supply provides power for the active ventilation system.

In accordance with another example embodiment, a soft headgear is provided. The soft headgear includes a soft outer layer, an inner liner layer formed from an air permeable material, an active ventilation system configured to move air, air conduction pathways formed between the soft outer layer and the inner liner layer, and a power supply operably coupled to the active ventilation system. The air conduction pathways allows for the circulation of air motivated by the active ventilation system, the air is drawn in from inlet vents disposed in a base of the soft headgear and out through a crown of the soft headgear. The power supply provides power for the active ventilation system.

BRIEF DESCRIPTION OF THE DRAWINGS

For a more complete understanding of the present disclosure, and the advantages thereof, reference is now made to the following descriptions taken in conjunction with the accompanying drawing, in which.

DETAILED DESCRIPTION OF ILLUSTRATIVE EMBODIMENTS

Figure 1:
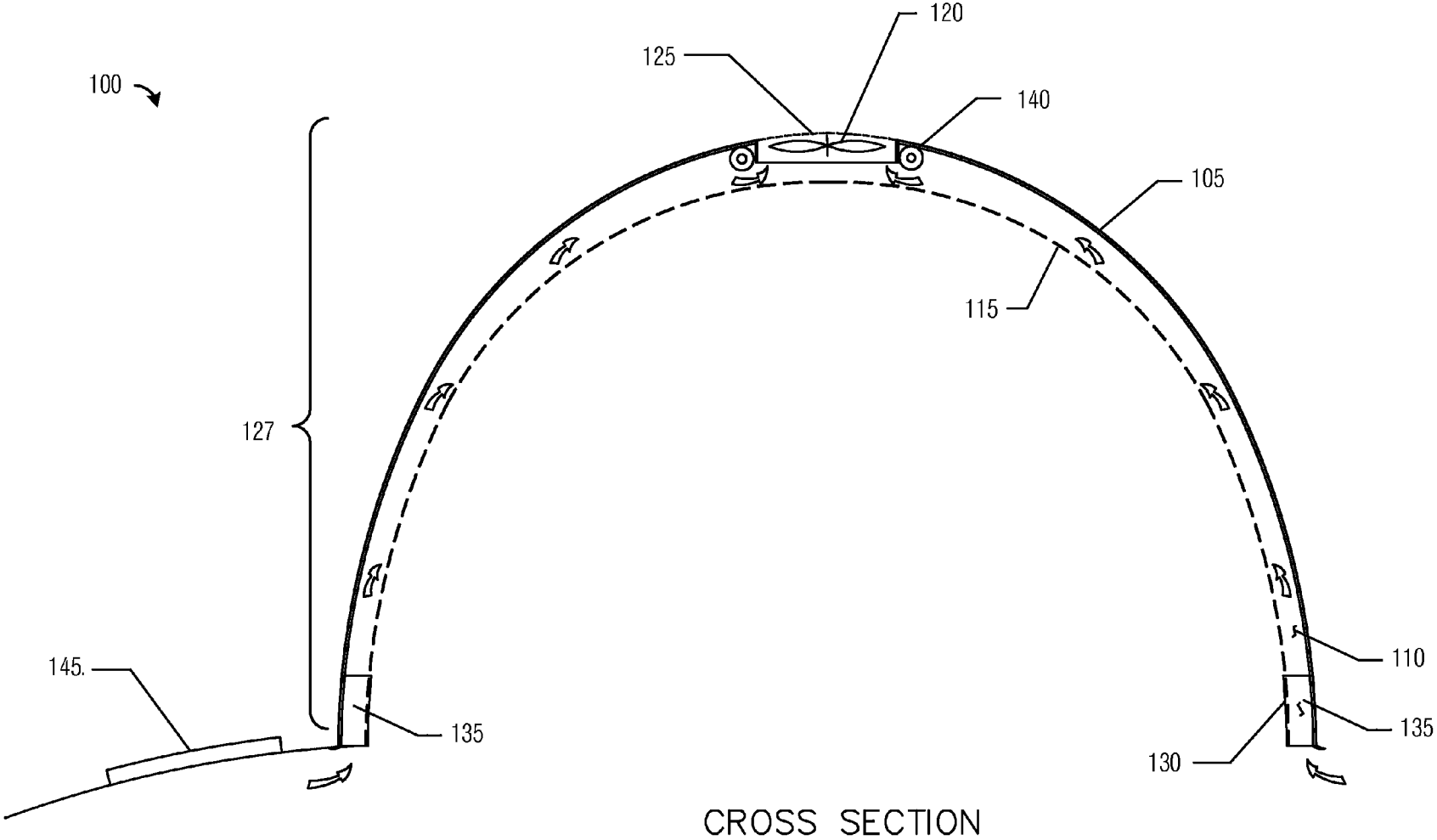
FIG. 1 illustrates a cross section view of an example soft headgear according to example embodiments described herein.

The structure of the current example embodiments are discussed in detail below. It should be appreciated, however, that the present disclosure provides many applicable inventive concepts that can be embodied in a wide variety of specific contexts. The specific embodiments discussed are merely illustrative of specific structures of the embodiments disclosed herein, and do not limit the scope of the disclosure.

Soft headgear general fits snugly around the top portion of the head of the wearer, providing relief from the sun by shading the head and eyes of the wearer. However, the snug fit of the soft headgear over the top of the head typically impedes air flow over the head. Therefore, there is a closed air space formed between a soft material (usually a natural or synthetic woven or unwoven fabric or a natural or synthetic material such as a plastic, vinyl, leather, rubber, vinyl or plastic coated fabric, and the like) of the soft headgear and the head of the wearer. The closed air space can get hot and humid, especially while the wearer of the soft headgear is outdoors or is participating in a rigorous activity. Some soft headgear includes passive ventilation in the form of a plurality of ventilation ports, such as holes, slits, air gaps, or vents, formed in the soft material of the soft headgear to provide ventilation for the closed air space and provide relief for the wearer. However, any air movement through the plurality of ventilation ports is normally minimal, as is the cooling effects afforded by the passive ventilation.

According to an example embodiment, soft headgear with a rigid substructure disposed between a soft outer layer and an inner liner layer of the soft headgear is provided. The rigid substructure establishes air conduction pathways between the soft outer layer and the inner liner layer. The rigid substructure conforms to the crown of the soft headgear and does not alter the shape of the soft headgear. The inner liner layer may come into direct contact with the head of the wearer. The inner liner layer may prevent hair on the head of the wearer from entering the rigid substructure. The inner liner layer may be air permeable, such as a mesh, a net, or a perforated material.

According to an example embodiment, soft headgear with a rigid substructure including an active ventilation system located at the top of the crown of the soft headgear is provided. The active ventilation system forcibly moves air drawn in through ventilation ports or air gaps formed in and around a periphery of a lower portion of the rigid substructure and out the top of the crown of the soft headgear, thereby cooling the head of the wearer. Alternate locations for the active ventilation system are also possible, including the back, front, or sides of the crown of the soft headgear. An output port where the air exits the soft headgear may be hidden by decoration, such as a logo, emblem, or symbol.

According to an example embodiment, soft headgear with a rigid substructure including an active ventilation system powered by batteries and optionally supplemented by solar cells is provided. The active ventilation system may be located in a hub at the top of the crown of the soft headgear. The batteries may be located in the rigid substructure along with the active ventilation system. The batteries may be part of the active ventilation system or coupled to the active ventilation via electrical wires. The solar cells may charge the batteries or provide power directly to the active ventilation system.

FIG. 1 illustrates a cross section view of an example soft headgear 100. Soft headgear 100 includes a soft outer layer 105, which may be made from a variety of soft pliable materials, including but not limited to natural and synthetic woven or unwoven fabrics, natural or synthetic materials such as a plastic, vinyl, leather, rubber, vinyl or plastic or rubber coated fabric, and the like. Soft outer layer 105 may be coated with an ultraviolet (UV) light absorbing coating. Soft headgear 100 also includes an inner liner layer 115 and a rigid substructure 110 disposed between soft outer layer 105 and inner liner layer 115. Rigid substructure 110 is located in a crown 127 of soft headgear 100. Rigid substructure 110 establishes air conduction pathways in the crown between soft outer layer 105 and inner liner layer 115. Rigid substructure 110 mimics the shape of soft headgear 100 so as to not alter the shape of soft headgear 100. Rigid substructure 110 may be semi-spherical in shape. Rigid substructure 110 is formed from a plastic material. Rigid substructure 110 is injection molded.

A detail description of example embodiments of rigid substructure 110 is provided below. Inner liner layer 115 is formed from an air permeable material, such as a mesh, a net, or a perforated material. Inner liner layer 115 prevents hair of the wearer from entering the air conduction pathways and potentially being drawn into an active ventilation system 120.

Active ventilation system 120 forcibly moves air through the air conduction pathways established by rigid substructure 110 disposed between soft outer layer 105 and inner liner layer 115 and out of soft headgear 100, thereby cooling the head of the wearer. As the air moves through the air conduction pathways, it helps to remove heat and moisture generated by the head of the wearer, thereby making the wearer more comfortable. As shown in FIG. 1, air is drawn into soft headgear 100 by way of inlet vents or air gaps located in a ring 135 of rigid substructure 110 and out of a top 125 of crown 127 of soft headgear 100. Ring 135 forms a base of soft headgear 100. Alternate locations of the inlet vents or air gaps are possible, such as in a backside, side, and/or front side of soft headgear 100. A headband 130, which may be detachable, may be attached to ring 135 formed in rigid substructure 110, may provide additional comfort for the wearer.

Active ventilation system 120 may be implemented using a direct current (DC) fan and may be powered by a battery (or a battery pack) 140. One or more solar cells 145 may also be used to power active ventilation system 120. Alternatively, the one or more solar cells 145 may supplement battery 140, which powers active ventilation system 120. The one or more solar cells 145 may be located on a brim of soft headgear 100, on an exterior surface of soft outer layer 105, or integrated into soft outer layer 105. A direct current fan that is capable of generating 3-6 cubic feet per minute (CFM) of air flow provides adequate cooling while not requiring a large battery 140. More powerful fans may be used to provide greater cooling at the expense of a larger battery 140 or solar cells 145.

Figure 2:
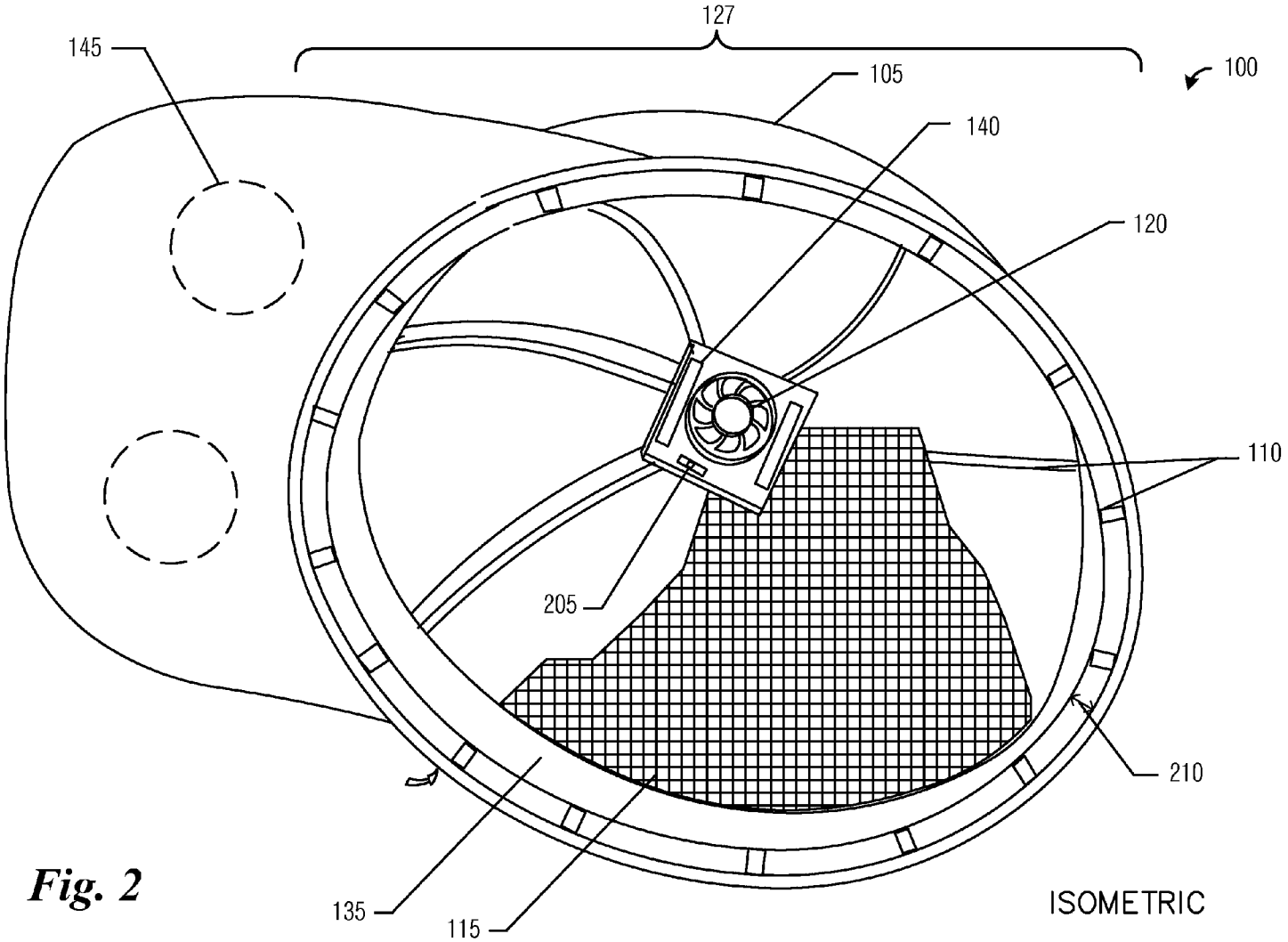
FIG. 2 illustrates an isometric view of soft headgear according to example embodiments described herein.

FIG. 2 illustrates an isometric view of soft headgear 100. In the isometric view, active ventilation system 120 is clearly seen. A switch 205 is used to turn on or off active ventilation system 120. Also visible in the isometric view are inlet vents or air gaps 210 located in the bottom edge of ring 135 of rigid substructure 110. Only a portion of inner liner layer 115 is shown to illustrate internal parts of soft headgear 100. In practice, inner liner layer 115 would fully cover the inside of crown 127 of soft headgear 100. Headband 130 is omitted in FIG. 2.

Figure 3:
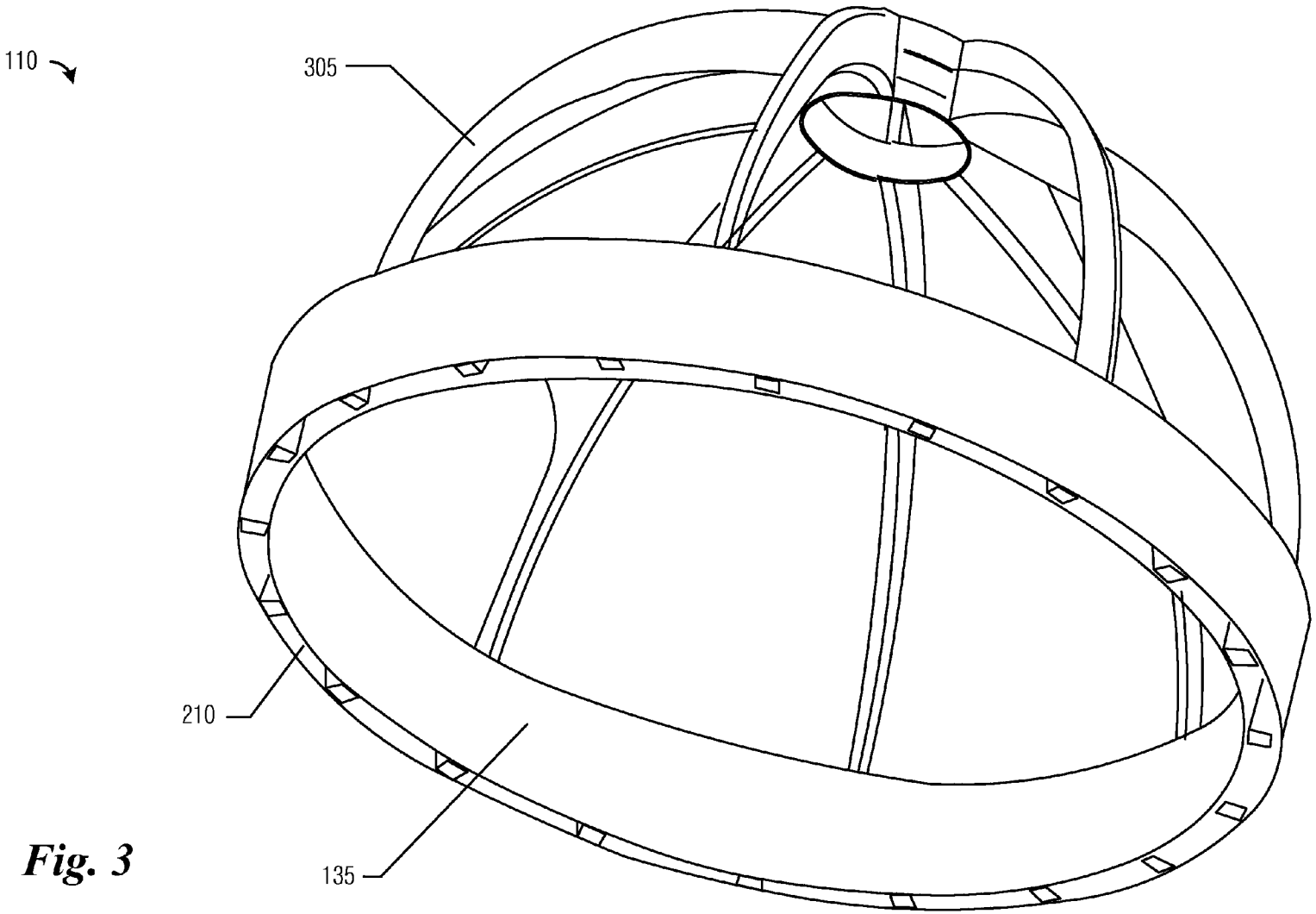
FIG. 3 illustrates an isometric view of rigid substructure according to example embodiments described herein.

FIG. 3 illustrates an isometric view of rigid substructure 110. As shown in FIG. 3, rigid substructure 110 includes a plurality of ribs, such as rib 305. Each rib in the plurality of ribs extends radially from a hub located at the crown of soft headgear 100 to ring 135 to form the air conduction pathways when in combination with soft outer layer 105 and inner liner layer 115 (neither shown in FIG. 3 to clearly illustrate rigid substructure 110). The plurality of ribs provides rigidity while forming the air conduction pathways. Also visible are inlet vents or air gaps 210 located in the bottom edge of ring 135 of rigid substructure 110. Inlet vents or air gaps 210 may be approximately 3/16-th of an inch in width. The ribbed structure of rigid substructure 110 provides for inlet vents or air gaps 210 to be formed substantially around the entirety of the base of rigid substructure 110. Active ventilation system 120 may be located in a hub at the crown of rigid substructure 110.

Figure 4:
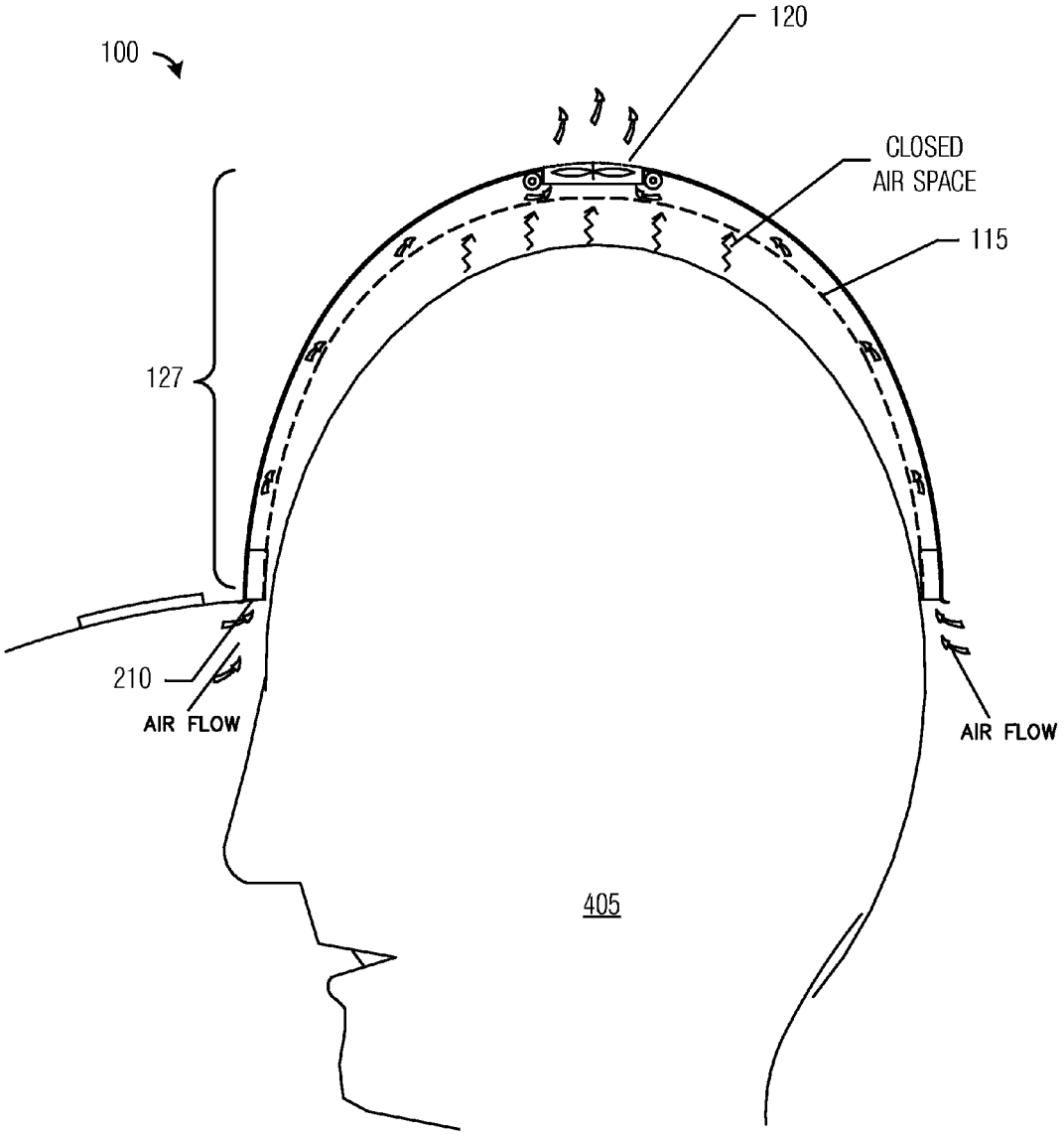
FIG. 4 illustrates a cross section view of soft headgear on a head according to example embodiments described herein.

FIG. 4 illustrates a cross section view of soft headgear 100 on a head 405. As shown in FIG. 4, active ventilation system 120 draws air through inlet vents or air gaps 210 and out top 125 of crown 127 of soft headgear 100, removing heat and moisture from closed air space formed between soft headgear 100 and head 405.

Figure 5:
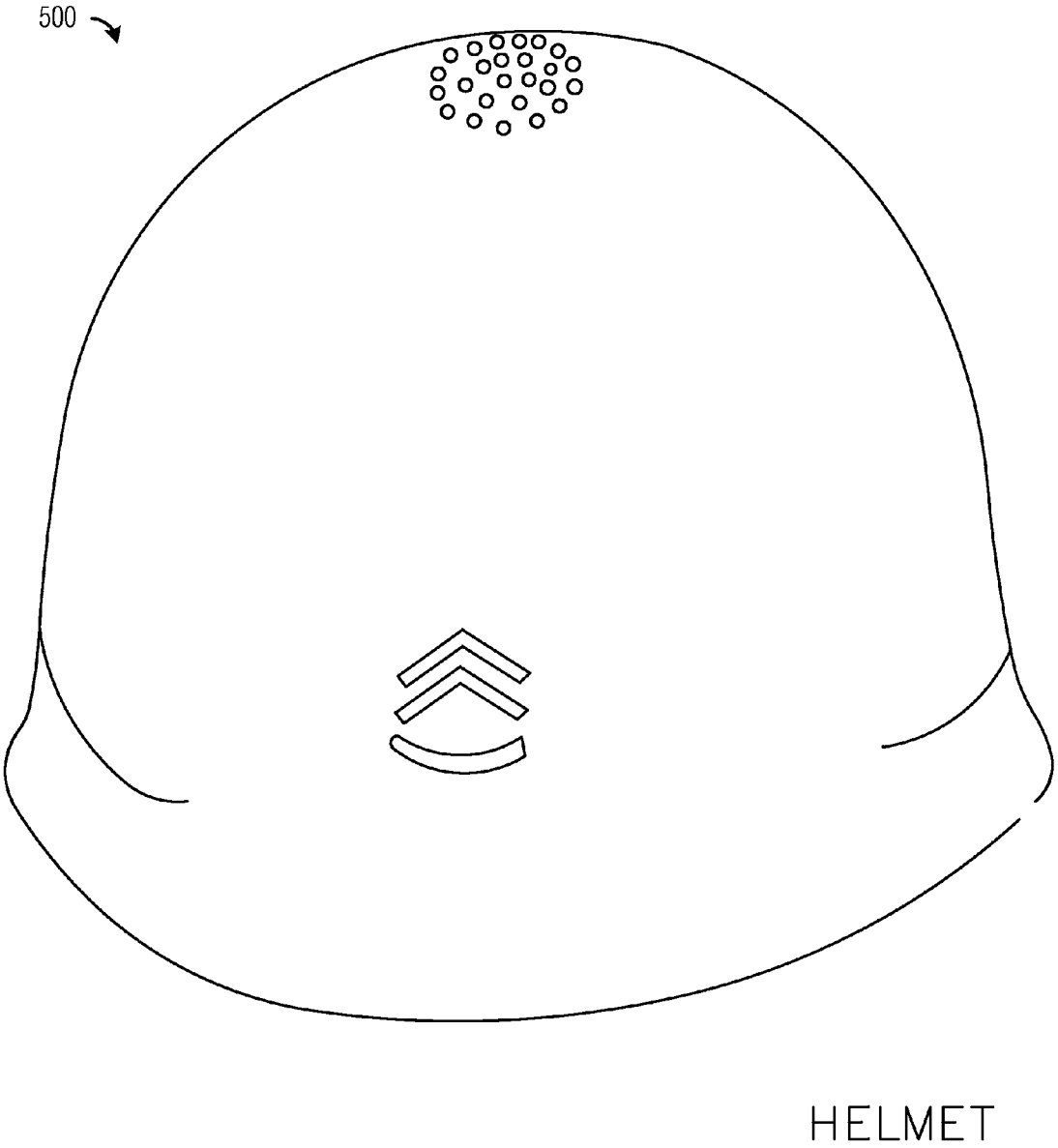
FIG. 5 illustrates a military helmet including an active ventilation system to provide comfort for the wearer according to example embodiments described herein.

FIG. 5 illustrates a military helmet 500 including an active ventilation system to provide comfort for the wearer.

Although the present disclosure and its advantages have been described in detail, it should be understood that various changes, substitutions and alterations can be made herein without departing from the spirit and scope of the disclosure as defined by the appended claims.

What is claimed is:

1. A soft headgear comprising:

a soft outer layer;

an inner liner layer formed from an air permeable material;

a rigid substructure disposed between the soft outer layer and the inner liner layer, the rigid substructure including a plurality of ribs extending radial from a top of a crown of the soft headgear to a ring of the rigid substructure, thereby forming air conduction pathways;

an active ventilation system located at the top of the crown of the soft headgear, the active ventilation system configured to exhaust air drawn in through the ring of the rigid substructure and out through the top of the crown of the soft headgear, and the air is drawn into the soft headgear through air vents formed in the soft outer layer of the soft headgear; and a power supply operably coupled to the active ventilation system, the power supply configured to provide power for the active ventilation system.

2. A soft headgear comprising:

a soft outer layer;

an inner liner layer formed from an air permeable material;

an active ventilation system configured to move air;

air conduction pathways formed between the soft outer layer and the inner liner layer, the air conduction pathways allowing a circulation of air motivated by the active ventilation system, the air is drawn in from inlet vents disposed in a base of the soft headgear and out through a crown of the soft headgear; and a power supply operably coupled to the active ventilation system, the power supply configured to provide power for the active ventilation system.

* * * * *